US009380878B1

(12) United States Patent
Chen

(10) Patent No.: US 9,380,878 B1
(45) Date of Patent: Jul. 5, 2016

(54) CHAIR HEADREST

(71) Applicant: ATEC INTERNATIONAL TEAM CO., LTD., Luzhu Township, Taoyuan County (TW)

(72) Inventor: Te-Chun Chen, Taoyuan (TW)

(73) Assignee: ATEC INTERNATIONAL TEAM CO., LTD., Luzhu Township, Taoyuan County (TW)

( * ) Notice: Subject to any disclaimer, the term of this patent is extended or adjusted under 35 U.S.C. 154(b) by 0 days.

(21) Appl. No.: 14/663,060

(22) Filed: Mar. 19, 2015

(51) Int. Cl.
*A47C 7/38* (2006.01)

(52) U.S. Cl.
CPC ..... *A47C 7/38* (2013.01)

(58) Field of Classification Search
CPC ..... A47C 7/38; A61G 15/125
USPC ..... 297/408, 410
See application file for complete search history.

(56) References Cited

U.S. PATENT DOCUMENTS 5,177,823 A * 1/1993 Riach ..... A47C 7/38 297/408
6,719,373 B2 * 4/2004 Zimmermann ..... A47C 7/38 297/391
6,857,704 B2 * 2/2005 Stenzel ..... A47C 7/38 297/408
7,093,313 B2 * 8/2006 DeBraal ..... A61G 13/121 297/408
7,610,639 B2 * 11/2009 Roleder ..... A47C 20/026 5/622
7,871,130 B2 * 1/2011 da Silva Netto ..... A47C 7/38 297/391
8,662,591 B2 * 3/2014 Lin ..... A47C 7/38 297/391
2005/0088027 A1 * 4/2005 Yetukuri ..... B60N 2/4817 297/408
2008/0258532 A1 * 10/2008 Cassaday ..... A47C 7/38 297/408
2008/0315648 A1 * 12/2008 Chen ..... A47D 13/105 297/250.1
2009/0200851 A1 * 8/2009 Link ..... A47C 7/38 297/410

* cited by examiner

*Primary Examiner* — David R Dunn
*Assistant Examiner* — Jody Giacoman
(74) *Attorney, Agent, or Firm* — Muncy, Geissler, Olds & Lowe, P.C.

(57) ABSTRACT

A chair headrest including a headrest, a pivot member and a fastener assembly is revealed. The headrest is disposed with a damper and a guide and stop member for improving vertical movement stability and safety during adjustment. The pivot member having pivotally connected first and second portions is arranged between the headrest and a seat back. The first portion includes a pivot part with two separate ends while the second portion has a mounting part with two apart ends. The pivot part fitted to the mounting part can be rotated around an actuation axis. The fastener assembly is set between two ends of the second portion and having a connection portion for connecting the two ends of the pivot part and the two ends of the mounting part and an actuator assembly for making the two ends of the mounting part apart to be in a pressed state.

17 Claims, 15 Drawing Sheets

CHAIR HEADREST

BACKGROUND OF THE INVENTION

Fields of the Invention

The present invention relates to a chair headrest, especially to a chair headrest that is not only titled to a desired angle but also adjusted vertically.

Generally, chairs with adjustable headrests allow users to lean back and provide support and comfort to their heads and necks. The structure of the chair includes a support rack on a seat back used for fixing a headrest to the seat back. However, such design has following shortcomings. Firstly the support rack is fixed on the seat back so that the headrest is unable to be adjusted vertically. Users with different height can't rest against the headrest comfortably. Moreover, the headrest is fixed on the support so that an inclined angle of the head rest is unable to be adjusted. The headrest can't provide support and comfort to heads and necks of the users on different postures.

SUMMARY OF THE INVENTION

Therefore it is a primary object of the present invention to provide a chair headrest that relieves loading of heads and necks of users with different body sizes or types after sitting for a long time.

It is another object of the present invention to provide a chair headrest that is able to be titled to a desired angle and adjusted vertically for providing users most comfortable positions to lean against.

It is a further object of the present invention to provide a chair headrest that features on high stability, good durability, easy maintenance, simple structure, low cost and easy operation.

In order to achieve the above objects, a chair headrest according to the present invention includes a headrest, a pivot member and a fastener assembly. The headrest consists of a front-side part, a middle part and a rear-side part. The front-side part and the middle part are connected to one part and are able to move vertically in relative the rear-side part. A damper is arranged between the middle part and the rear-side part to provide a resistance for buffering during vertical movement of the front-side part and the middle part in relative to the rear-side part. A guide and stop member is also disposed between the middle part and the rear-side part for guiding and stopping vertical movement of the front-side part and the middle part in relative to the rear-side part.

The pivot member is formed by a first portion and a second portion. One end of the first portion is set with a fixing part for being fixed on the sear back while a pivot part is arranged at the other end of the first portion corresponding to the end with the fixing part. The pivot part has two separate ends. One end of the second portion is disposed with an assembly part for being connected to the headrest while the other end of the second portion is arranged with a mounting part corresponding and fitted to the pivot part. The mounting part includes two separate ends corresponding to the two ends of the pivot part of the first portion respectively. The mounting part and the pivot part are pivotally connected to each other so that the first portion and a second portion can rotate around an actuation axis.

The fastener assembly is composed of a connection portion and an actuator assembly. The connection portion is arranged at the actuation axis and used for connecting the two ends of the pivot part of the first portion and the two ends of the mounting part of the second portion. The actuator assembly is used to make the two ends of the mounting part of the second portion become apart from each other along the actuation axis and move to an expanded and pressed state. The actuator assembly includes an actuating member, a first driven part and a second driven part that are fitted over the connection portion in turn. The actuating member can be rotated around the actuation axis. The actuating member is connected to one of the two ends of the pivot part of the first portion through the first driven part and further connected to one of the two ends of the mounting part of the second portion through the second driven part.

DETAILED DESCRIPTION OF THE PREFERRED EMBODIMENTS

Figure 1:
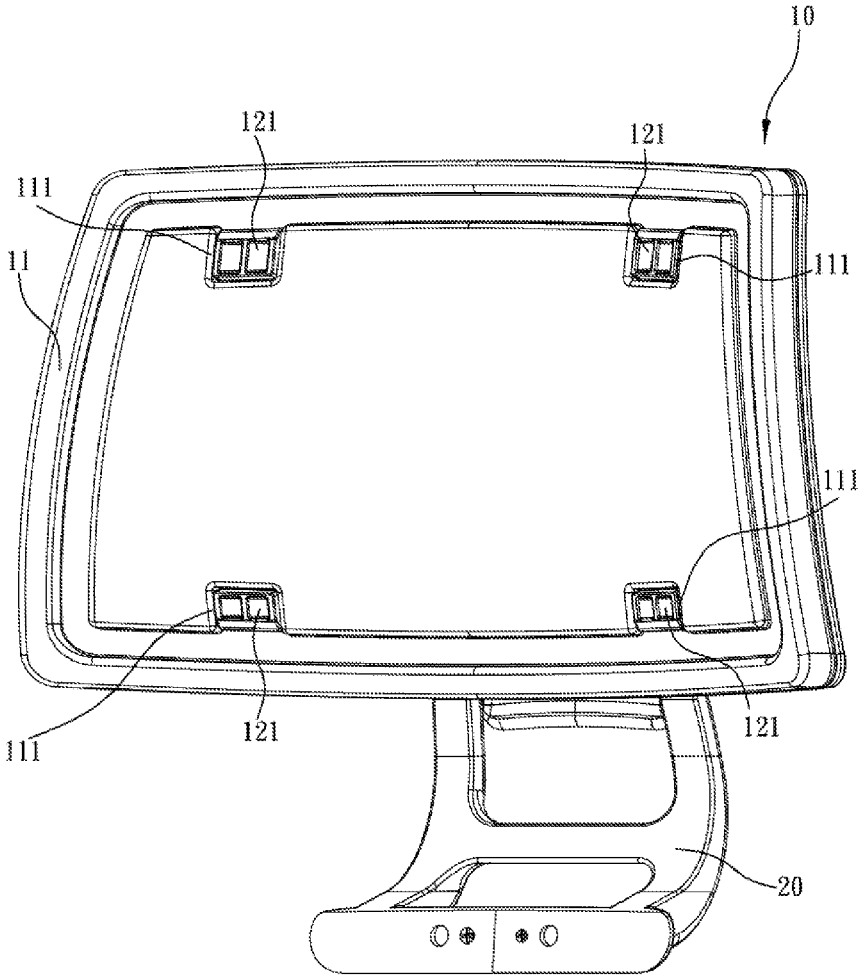
FIG. 1 is a perspective view of an embodiment of a chair headrest according to the present invention.
Figure 2:
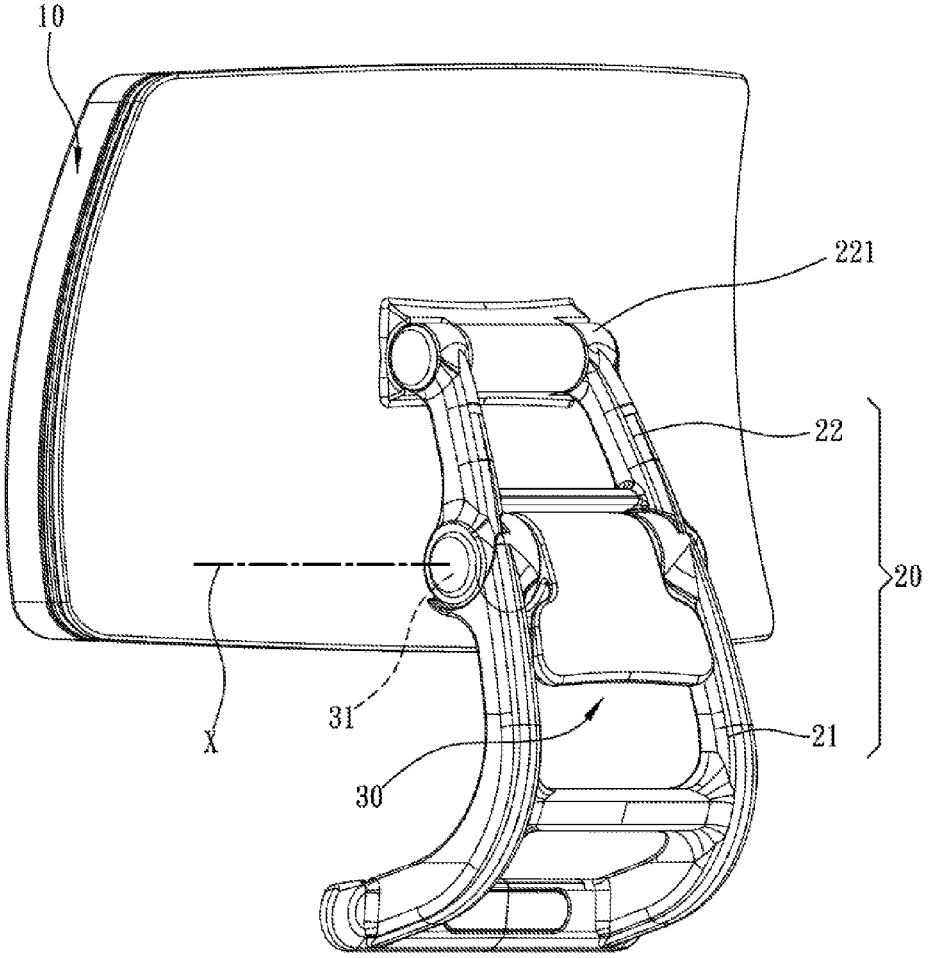
FIG. 2 is another perspective view of an embodiment of a chair headrest according to the present invention.

As shown in FIG. 1 and FIG. 2, a chair headrest 1 of the present invention includes a headrest 10, a pivot member 20 and a fastener assembly 30.

Figure 3:
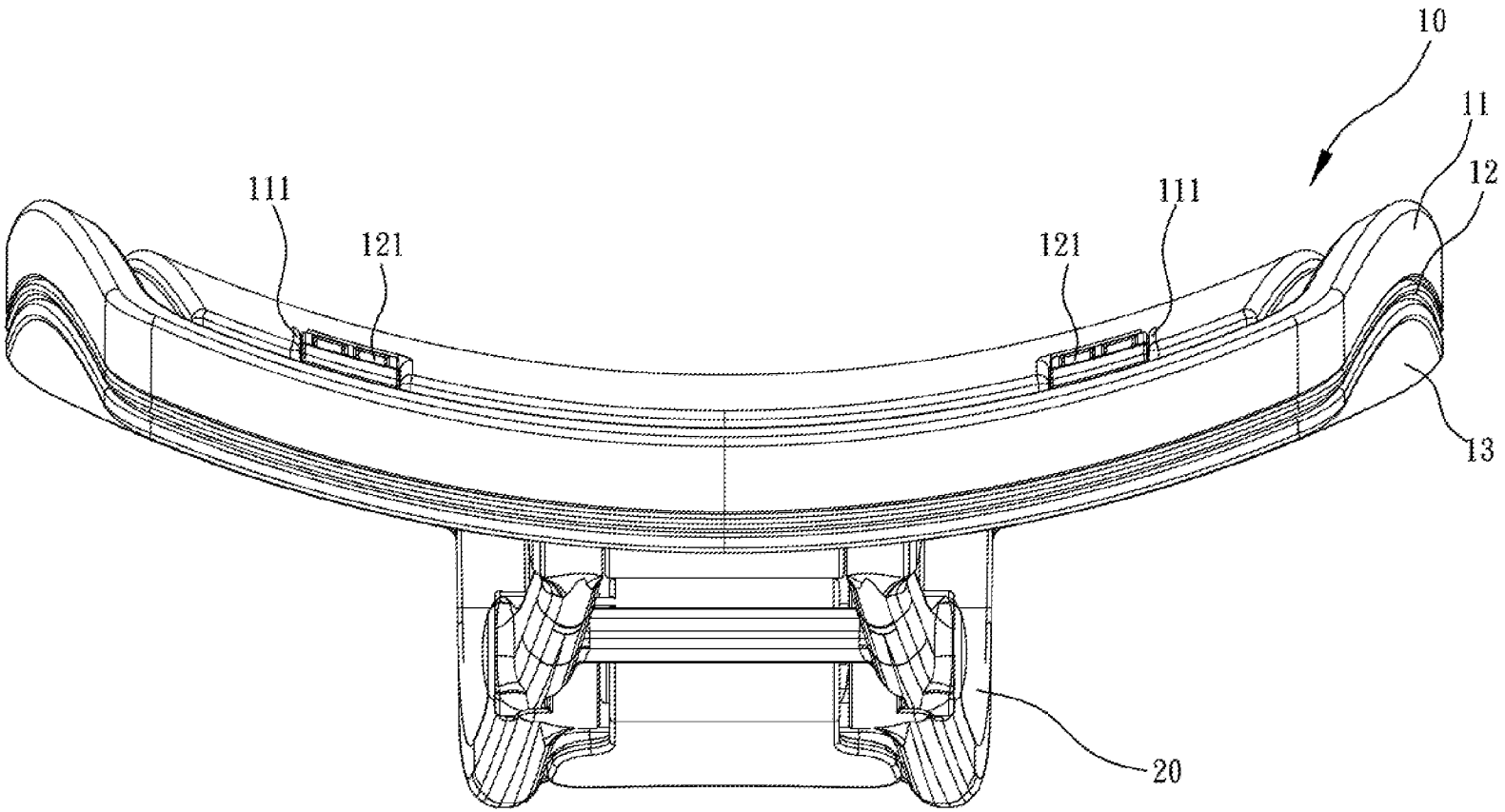
FIG. 3 is a top view of the embodiment in FIG. 1 according to the present invention.
Figure 4:
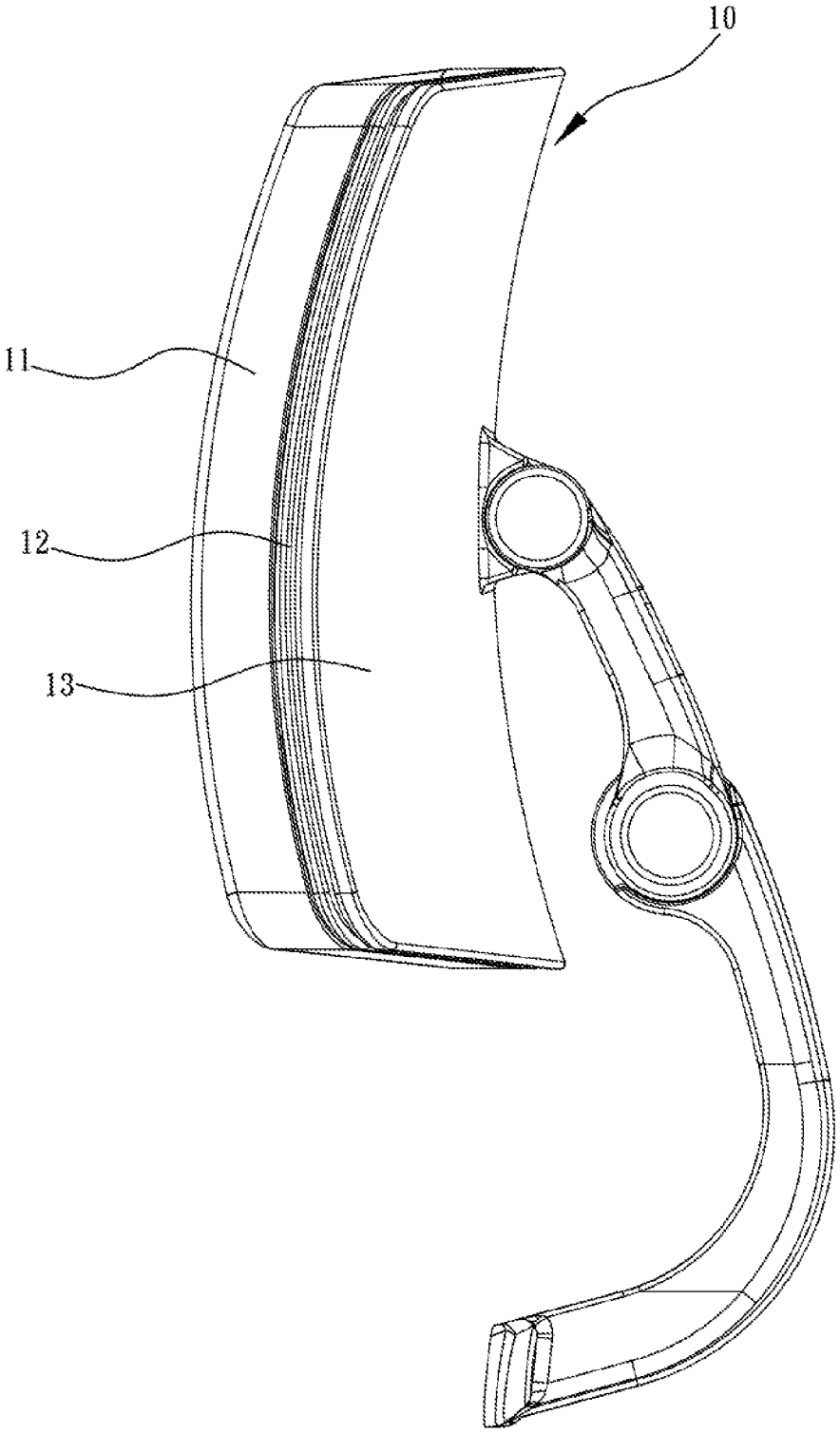
FIG. 4 is a side view of the embodiment in FIG. 1 according to the present invention.

As shown in FIG. 3, the headrest 10 has a concave surface on a top and a bottom view. Refer to FIG. 4, the headrest 10 has a convex surface once viewed horizontally. The headrest 10 consists of a front-side part 11, a middle part 12 and a rear-side part 13 set in turn. The front-side part 11 is disposed with at least two locking parts 111 with an interval therebetween and corresponding to each other. The locking part 111 can be, but not limited to, a through hole. The middle part 12 is arranged with at least two locked part 121 corresponding to and locked with the locking parts 111 respectively. The locked part 121 can be, but not limited to, a projecting block.

The front-side part 11 and the middle part 12 are connected to one part by the locking parts 111 and the locked part 121 assembled with each other. The part formed by the front-side part 11 and the middle part 12 connected to each other is able to be moved vertically in relative to the rear-side part 13.

Figure 5:
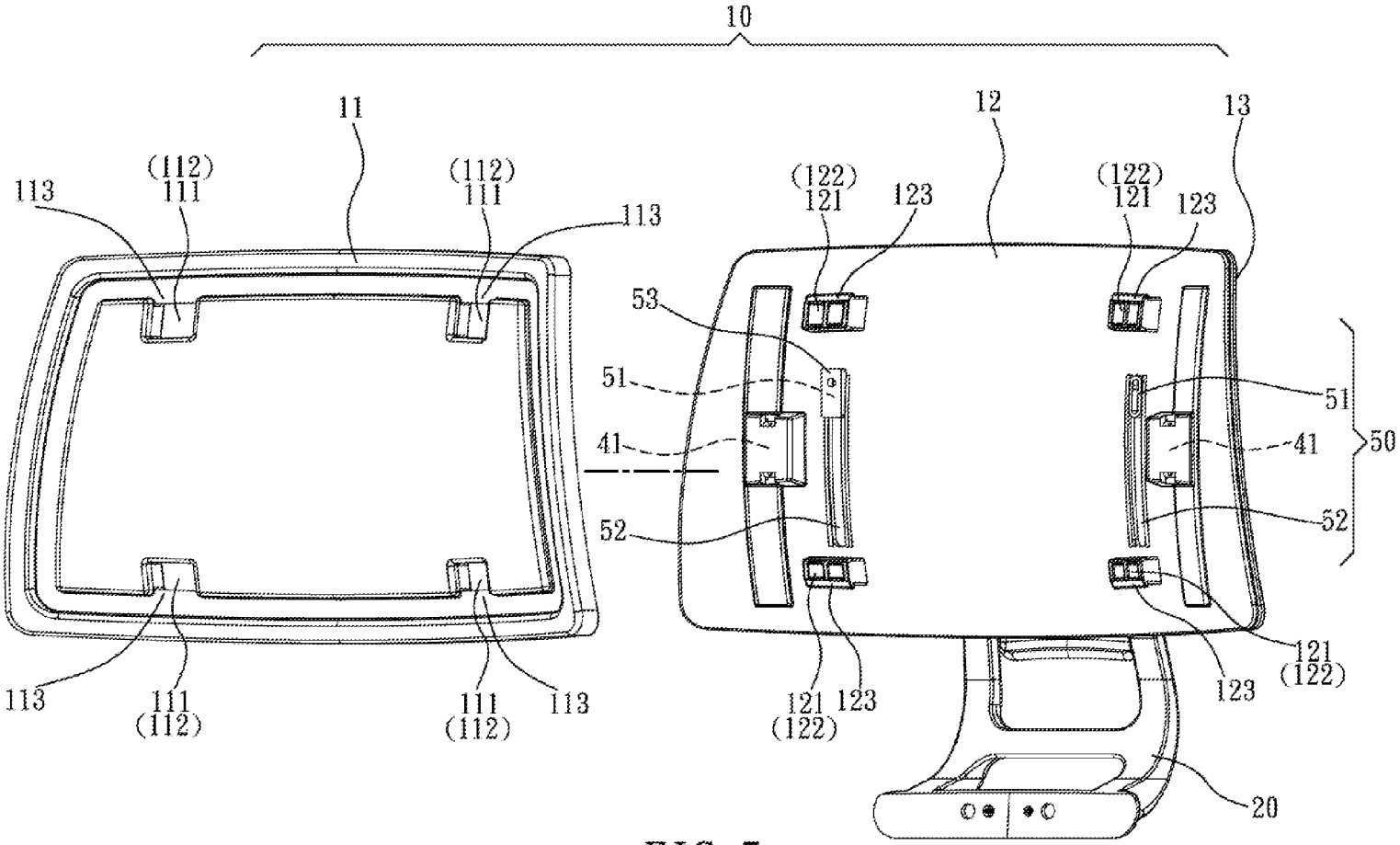
FIG. 5 is an explosive view of the embodiment in FIG. 1 according to the present invention.

As shown in FIG. 5, each locking part 111 includes a through hole 112 and the edge of the through hole 112 is set with at least one slot 113. Each locked part 121 includes a projecting block 122 that is disposed with a projection 123. The projection 123 is corresponding to and fastened with the slot 113. While the locking parts 111 and the locked part 121 are locked with each other, the projection 123 of the projecting block 122 is elastically mounted into the slot 113 of the through hole 112.

Figure 6:
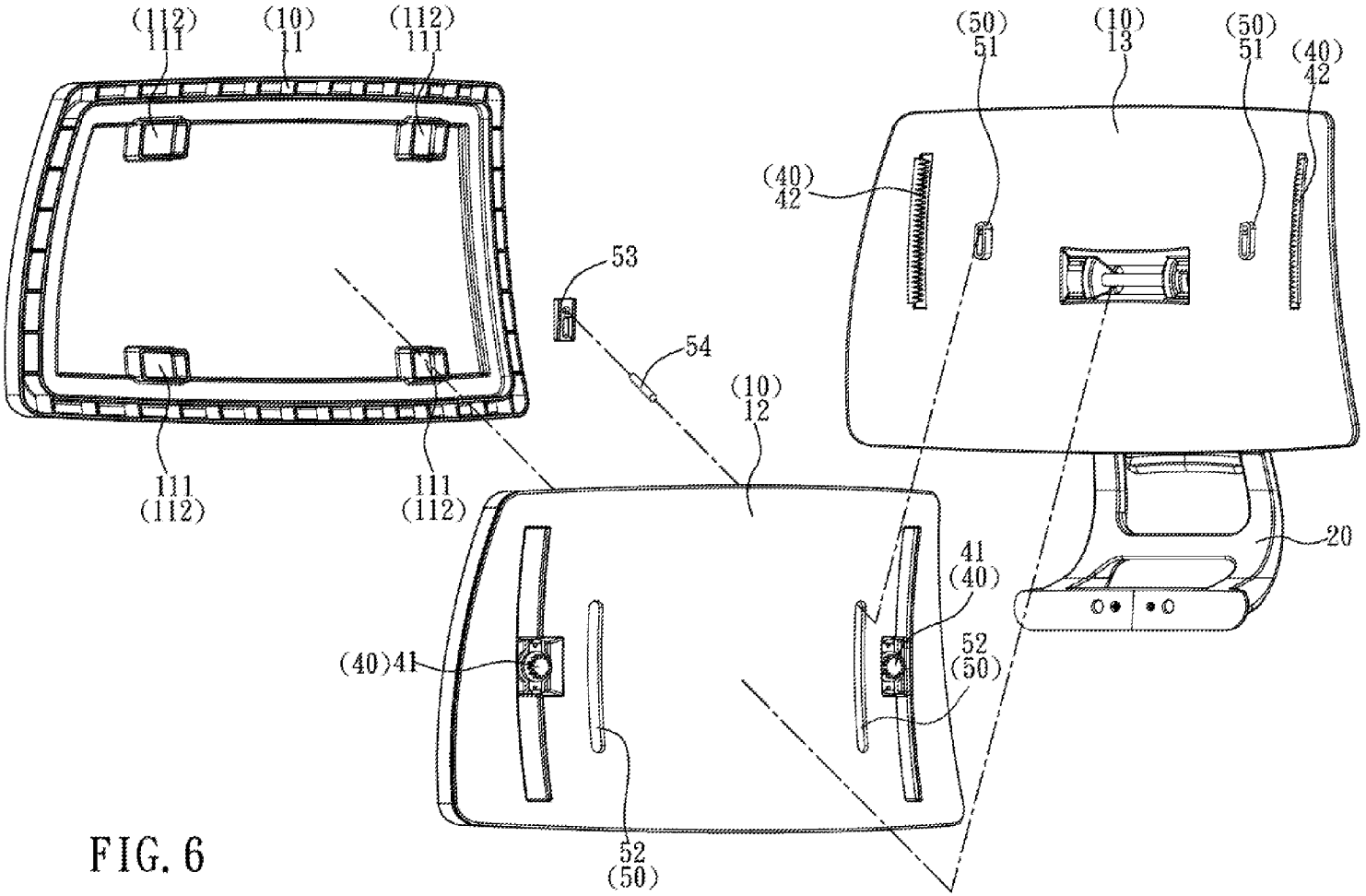
FIG. 6 is an explosive view of the embodiment in FIG. 5 in details according to the present invention.

As shown in FIG. 5 and FIG. 6, a damper 40 is arranged between the middle part 12 and the rear-side part 13 to provide a resistance for buffering and increase stability of the movement while the front-side part 11 and the middle part 12 are moved vertically in relative to the rear-side part 13. The damper 40 includes at least two damping wheels 41 and at least two toothed racks 42. Each wheel 41 is engaged with the toothed rack 42 correspondingly. The damping wheels 41 are disposed on the left side and the right side respectively of one surface of the middle part 12 facing the rear-side part 13 while the two toothed racks 42 are arranged vertically and in parallel at one surface of the rear-side part 13 facing the middle part 12. The position of the damping wheel 41 and that of the toothed rack 42 are interchangeable. Thereby the height of the front-side part 11 and the middle part 12 in relative to the rear-side part 13 can be adjusted by vertical movement. Thus the headrest 10 can be adjusted to a proper height for users to rest against.

A guide and stop member 50 is disposed between the middle part 12 and the rear-side part 13. The guide and stop member 50 is for guiding and stopping vertical movement of the front-side part 11 and the middle part 12 in relative to the rear-side part 13. Thus the displacement of the front-side part 11 and the middle part 12 in relative to the rear-side part 13 is more precise and safe. The guide and stop member 50 consists of at least two positioning blocks 51 and at least two grooves 52. The positioning block 51 can be passed through the groove 52 and moved along the length direction of the groove 52, as shown in FIG. 5 and FIG. 6. The two positioning blocks 51 are set on the left side and the right side respectively of one surface of the rear-side part 13 facing the middle part 12 while the two grooves 52 corresponding to the positioning blocks 51 are arranged vertically and in parallel at the middle part 12. The position of the positioning block 51 and that of the groove 52 are interchangeable. Thereby the height of the front-side part 11 and the middle part 12 in relative to the rear-side part 13 can be adjusted more precisely and safely by vertical movement due to the guide and stop member 50. Thus the headrest 10 can be adjusted to a proper height for users to rest against.

In order to increase stability of the movement of the positioning block 51 in the groove 52, the guide and stop member 50 further includes at least one positioning part 53. The positioning part 53 is arranged at the other side of the groove 5, opposite to the side with the positioning block 51. The positioning part 53 is further connected to the positioning block 51 by a connection part 54. As shown in FIG. 5 and FIG. 6, the groove 52 is clipped between the positioning part 53 and the positioning block 51. Thereby the positioning block 51 is moved within the groove 52 more stably due to the connection between the positioning part 53 and the positioning block 51 while the height of the front-side part 11 and the middle part 12 in relative to the rear-side part 13 is adjusted.

When the front-side part 11 is disposed with a pillow (not shown in figure) which the user's head rests against, the assembly of the front-side part 11 with the middle part 12 will not be affected. The assembly of the front-side part 11 with the middle part 12 is not affect and getting easier due to the projection 123 of the projecting block 122 of the locked part 121 and the slot 113 of the through hole 112 of the locking part 111.

Figure 7A:
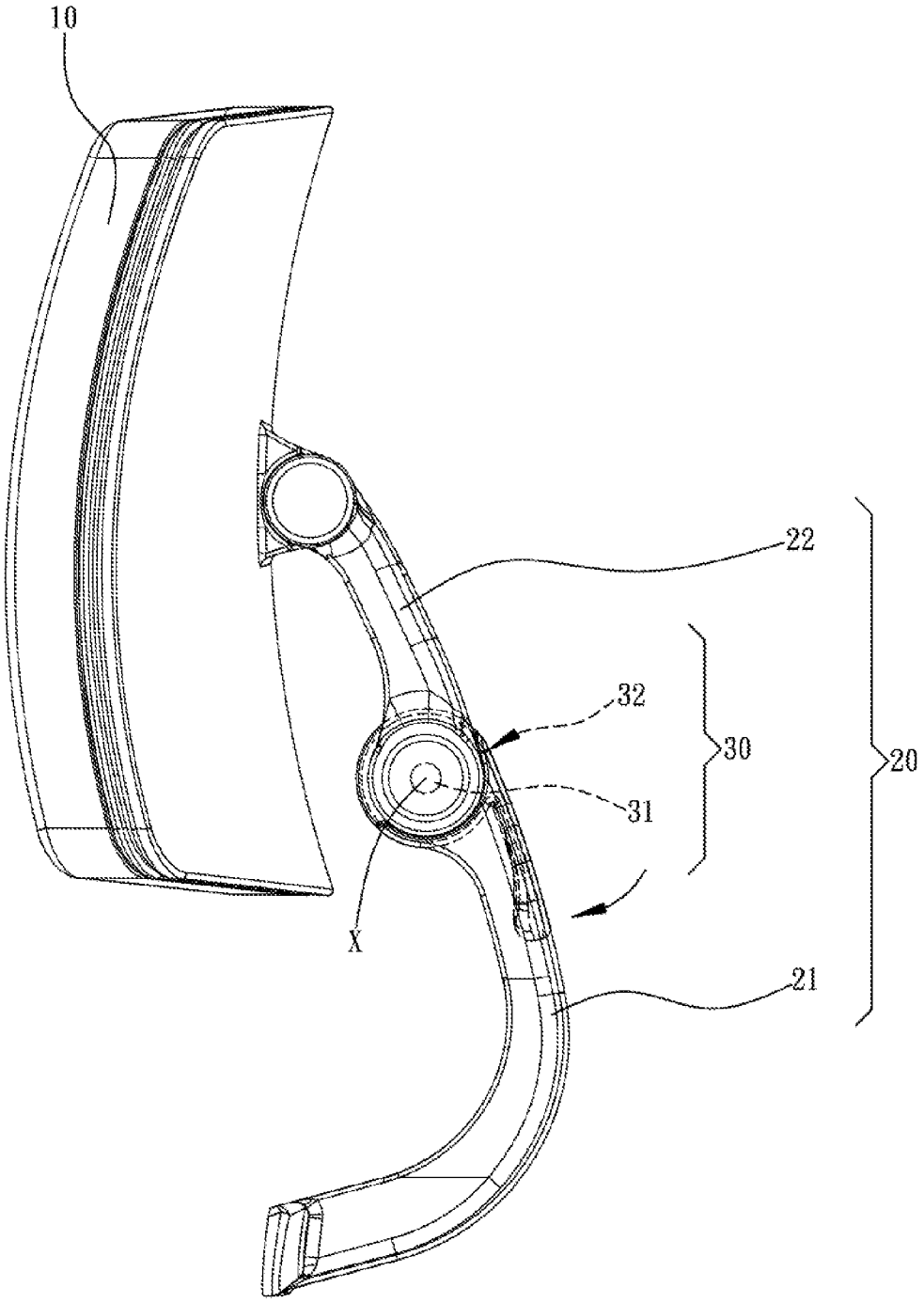
FIG. 7A and FIG. 7B are side views showing an embodiment at a fastened position and at a released position respectively according to the present invention.
Figure 7B:
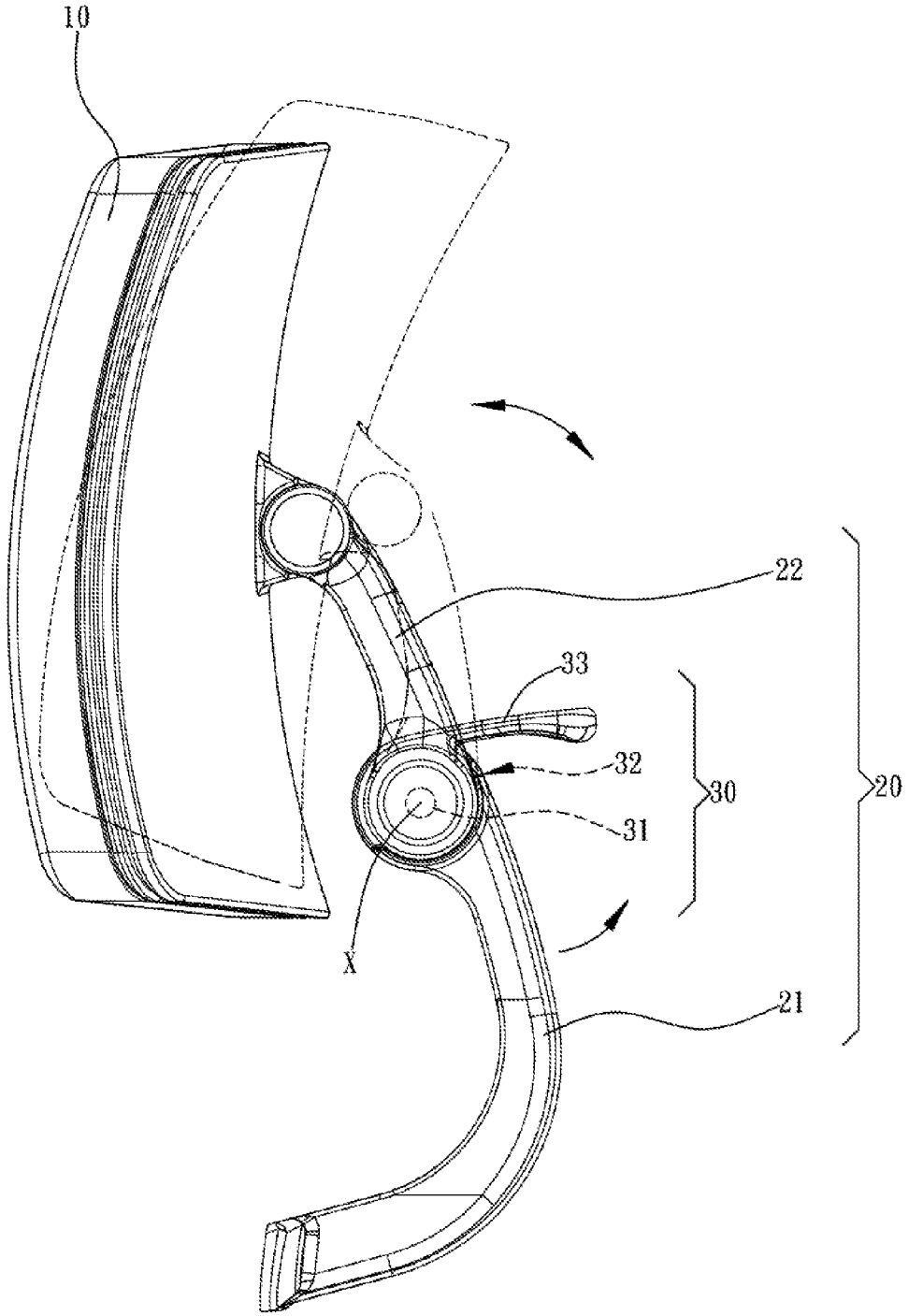
Figure 8:
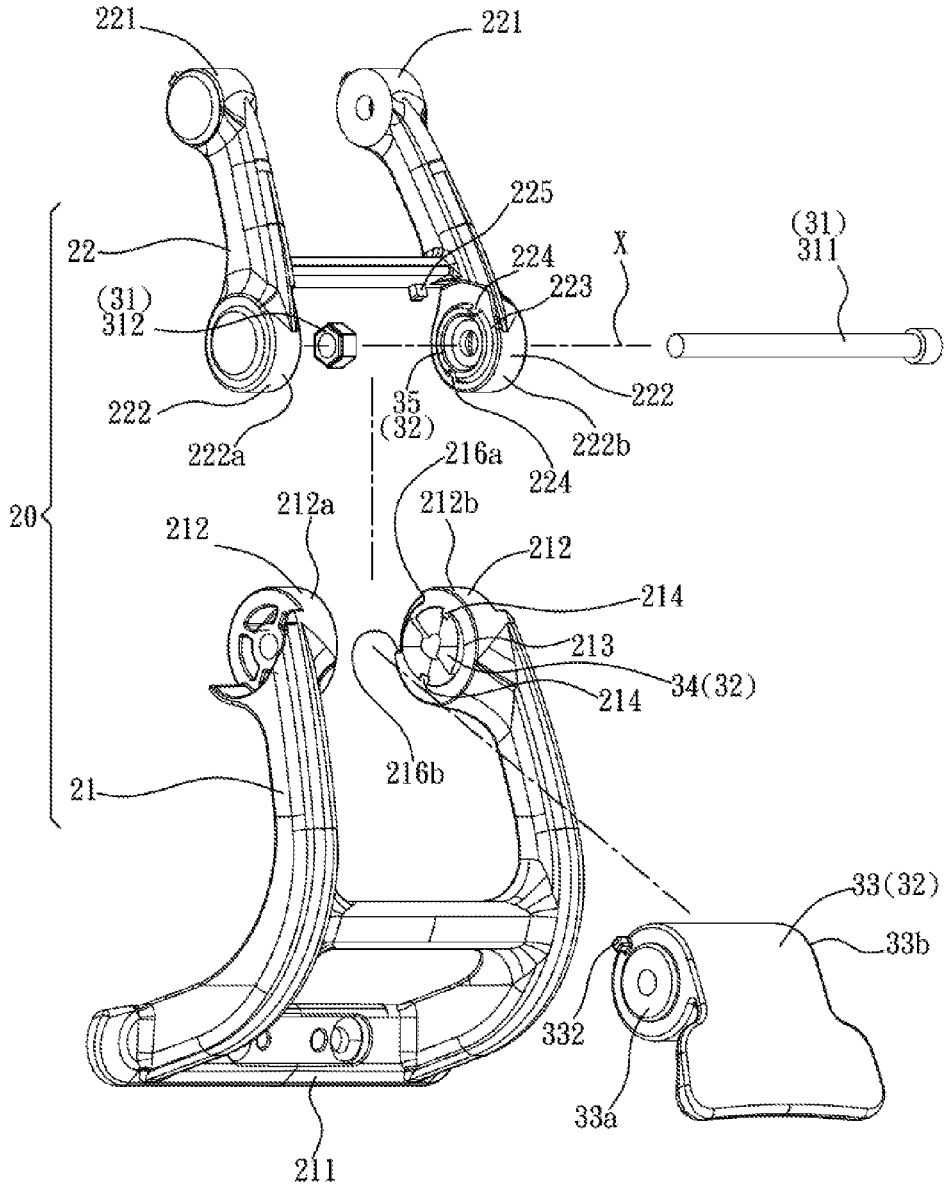
FIG. 8 is an explosive view of a pivot member and a fastener assembly of the embodiment in FIG. 2 according to the present invention.
Figure 9:
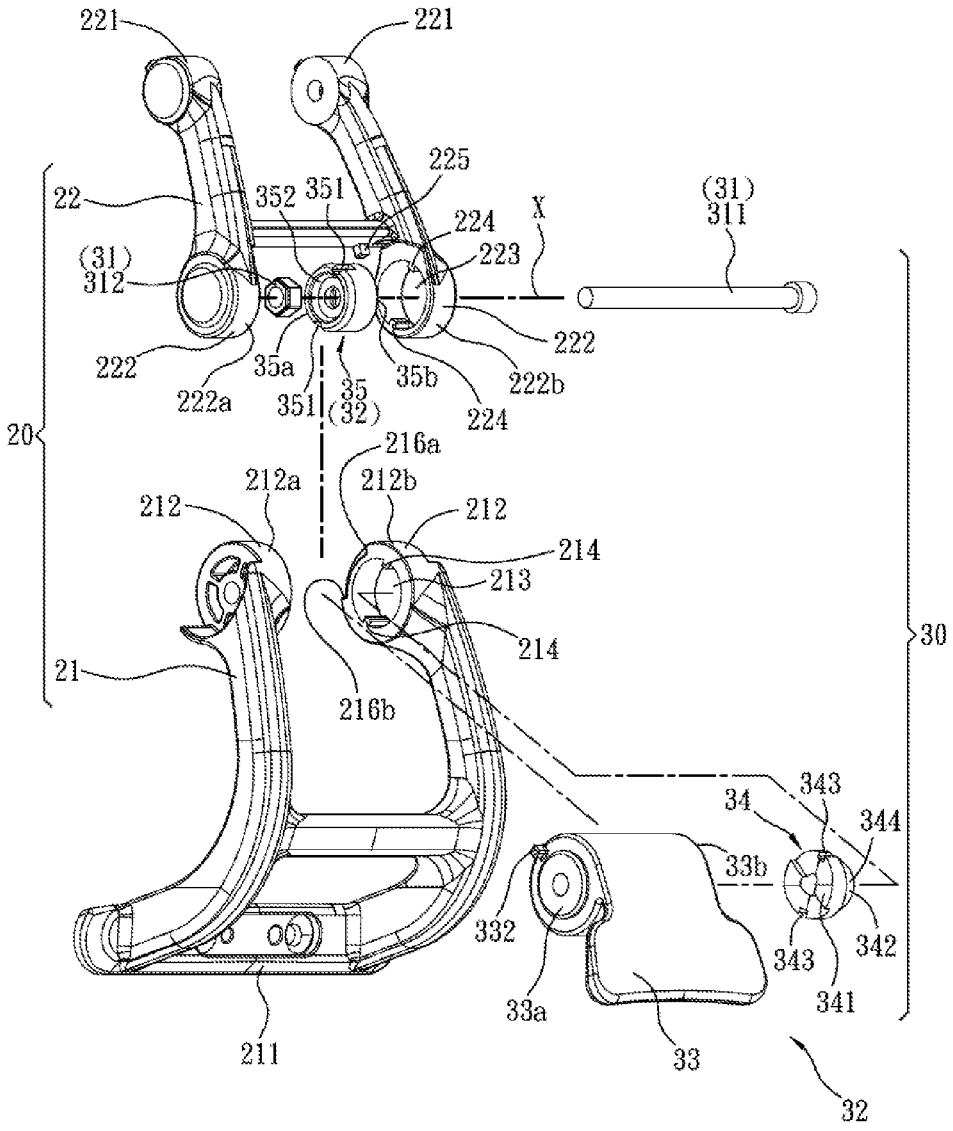
FIG. 9 is a more detailed explosive view of a pivot member and a fastener assembly of the embodiment in FIG. 8 according to the present invention.
Figure 10:
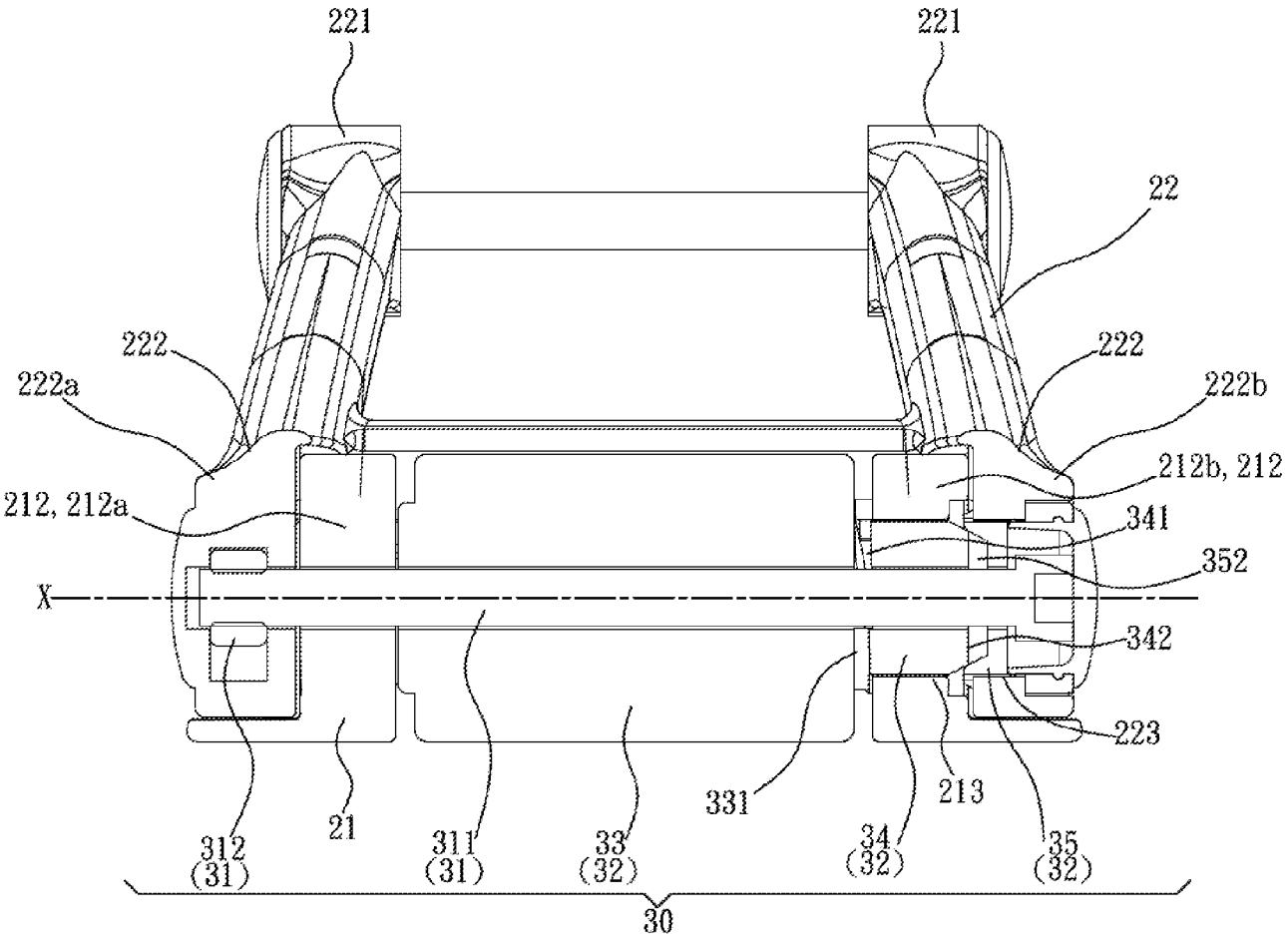
FIG. 10 is a vertical cross section of the embodiment in FIG. 2 according to the present invention.
Figure 11:
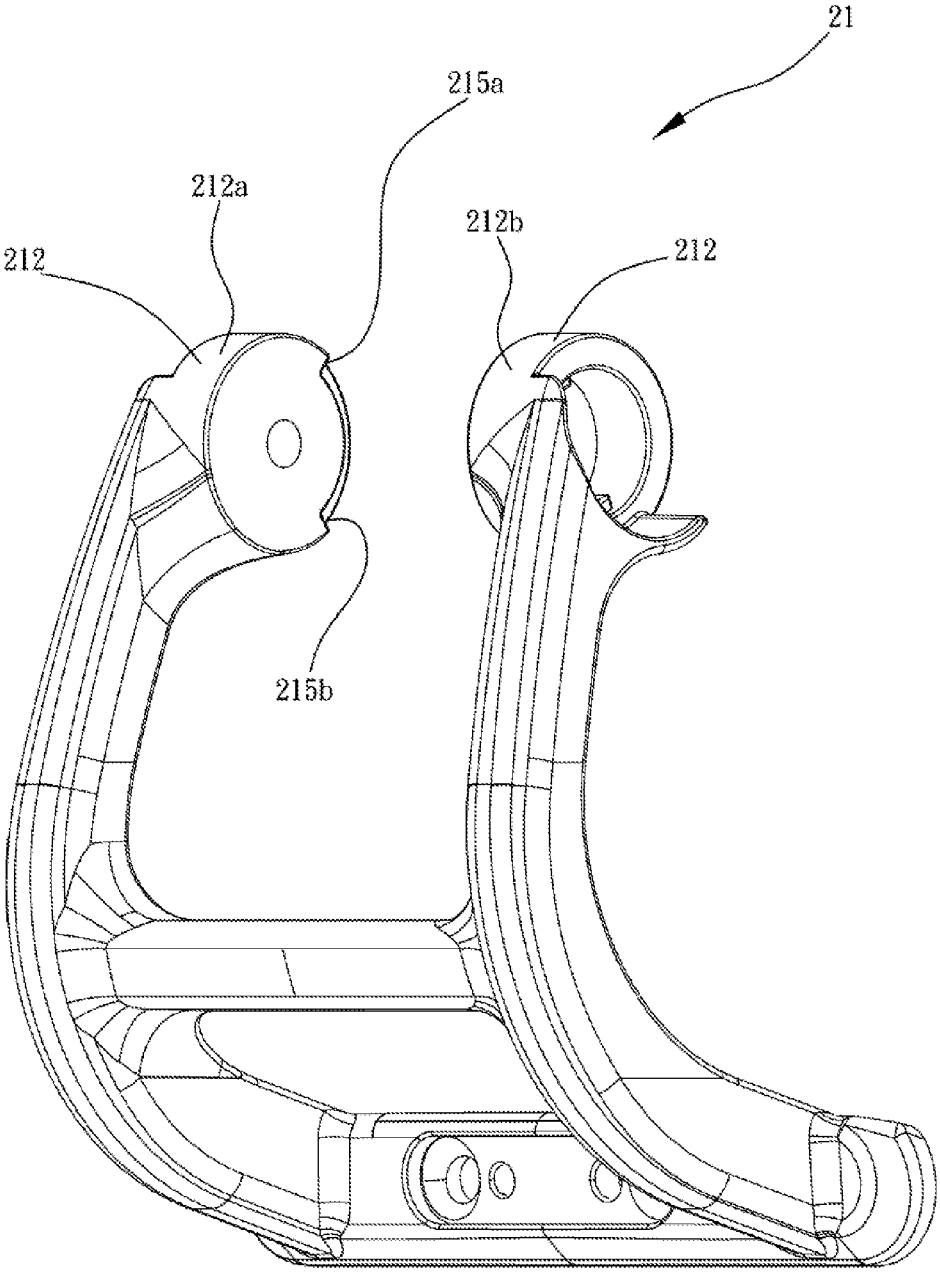
FIG. 11 is a perspective view of a first portion of an embodiment according to the present invention.

Refer from FIG. 7A, FIG. 7B, and FIG. 8, the pivot member 20 is disposed between the headrest 10 and the seat back (not shown in figure) and including a first portion 21 and a second portion 22. One end of the first portion 21 is arranged with a fixing part 211 for being fixed on the sear back while a pivot part 212 is disposed on the other end of the first portion 21 corresponding to the end with the fixing part 211. The pivot part 212 consists of two separate ends 212*a*, 212*b* arranged symmetrically and having a certain interval therebetween. One end 212*b* is mounted with a first receiving space 213 and at least two first projections 214 with an interval therebetween are disposed in the first receiving space 213. A first stopping part 215*a* and a second stopping part 215*b* with an interval therebetween are set on the circumference of the other end 212*a*, as shown in FIG. 11. Refer to FIG. 8 and FIG. 9, a first stopping part 216*a* and a second stopping part 216*b* with an interval therebetween are arranged at the circumference of the end 212*b*.

One end of the second portion 22 is disposed with an assembly part 221 for being fixed and set on the rear-side part 13 of the headrest 10 while the other end of the second portion 22 is arranged with a mounting part 222 corresponding and fitted to the pivot part 212 of the first portion 21. The mounting part 222 includes two separate ends 222*a*, 222*b* with a certain interval therebetween. In an embodiment of the present invention, the two ends 222*a*, 222*b* of the mounting part 222 can be moved along an actuator axis X to be apart from each other in an expanded state. The two ends 222*a*, 222*b* of the mounting part 222 are corresponding to the two ends 212*a*, 212*b* of the pivot part 212 of the first portion 21. The mounting part 222 and the pivot part 212 are pivotally connected to each other so that the first portion 21 and a second portion 22 can rotate around the actuation axis X. One end 222*b* of the mounting part 222 of the second portion 22 is set with a second receiving space 223 and at least two second projections 224 with an interval therebetween are disposed in the second receiving space 223. The second portion 22 further includes a third projection 225 corresponding to and leaning against the first stopping part 216*a* and the second stopping part 216*b* on the end 212*b* of the pivot part 212 of the first portion. The third projection 225 is located on a rotating path of the first stopping part 216*a* and the second stopping part 216*b* on the end 212*b* of the pivot part 212. Thus the rotation angle of the second portion 22 in relative to the first portion 21 can be limited by the first and the second stopping parts 216*a*, 216*b* due to limited movement of the third projection 225 of the second portion 22 between the first stopping part 216*a* and the second stopping part 216*b* while the second portion 22 is rotated in relative to the first portion 21.

Refer to FIG. 7A and FIG. 7B, the fastener assembly 30 is composed of a connection portion 31 and an actuator assembly 32. In this embodiment, the axis of the connection portion 31 and the actuator assembly 32 is aligned with the actuation axis X. The fastener assembly30 is mounted between the two ends 212*a*, 212*b* of the pivot part 212 of the first portion 21 and the two ends 222*a*, 222*b* of the mounting part 222 of the second portion 22. At a released position (as shown in FIG. 7B), the user can adjust the pivot angle of the second portion 22 in relative to the first portion 21 and then fasten the second portion 22 on the desired position. Thus the fastened second portion 22 is inclined to the desired angle at a fastened position (as shown in FIG. 7A).

Refer to FIG. 8, the connection portion 31 is inserted through the actuator assembly 32 along the actuation axis X, and then passed through the two ends 212*a*, 212*b* of the pivot part 212 of the first portion 21 and the two ends 222*a*, 222*b* of the mounting part 222 of the second portion 22 so as to connect the two ends 212*a*, 212*b* of the pivot part 212 of the first portion 21 and the two ends 222*a*, 222*b* of the mounting part 222 of the second portion 22. As shown in FIG. 8 and FIG. 9, the connection portion 31 consist of a first connection element 311 (such as a screw/bolt), and a second connection element 312 (such as a nut). One end of the first connection element 311 is passed through the two ends 212*a*, 212*b* of the pivot part 212 of the first portion 21 and the two ends 222*a*, 222*b* of the mounting part 222 of the second portion 22 for connecting the two ends 212*a*, 212*b* of the first portion 21 to the two ends 222*a*, 222*b* of the second portion 22 and then the second connection element 312 is threaded and connected to the end of the first connection element 311. In this embodiment, the actuation axis X is aligned with the axis of the first connection element 311 (such as a screw/bolt) and the axis of the second connection element 312 (such as a nut) and the length of the connection portion 31 is adjustable.

The actuator assembly 32 is used to make the two ends 222*a*, 222*b* of the mounting part 222 of the second portion 22 become apart from each other along the actuation axis X and move to the expanded and pressed state. The actuator assembly 32 is composed of an actuating member 33, a first driven part 34 and a second driven part 35 that are fitted over the connection portion 31 in turn. By the connection portion 31, the chair headrest 1 is coaxial with the actuator assembly 32. Moreover, sufficient tension or traction force is applied to the two ends 222*a*, 222*b* of the mounting part 222 of the second portion 22 while the actuator assembly 32 works due to design of the interval set between the actuating member 33, the first driven part 34, and the second driven part 35.

Figure 12A:
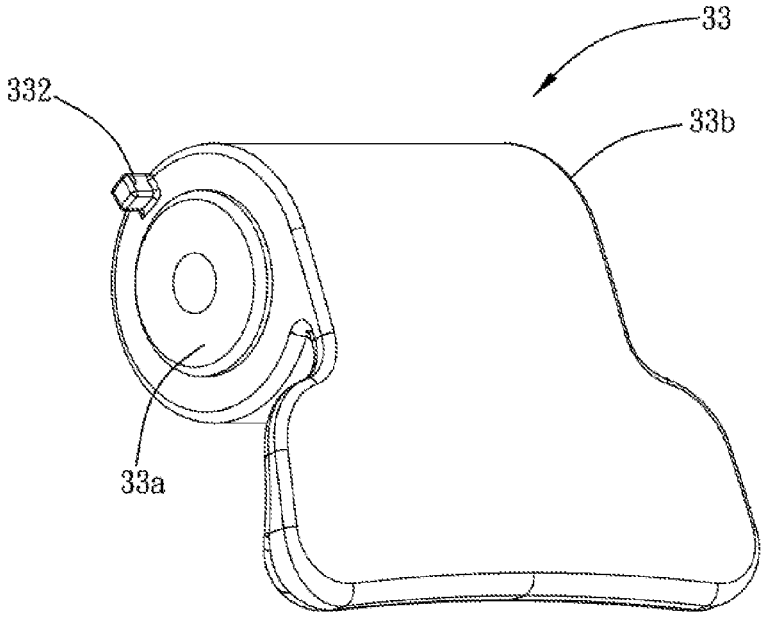
FIG. 12A and FIG. 12B are perspective views of an actuating member of an embodiment viewed from two opposite sides according to the present invention.
Figure 12B:
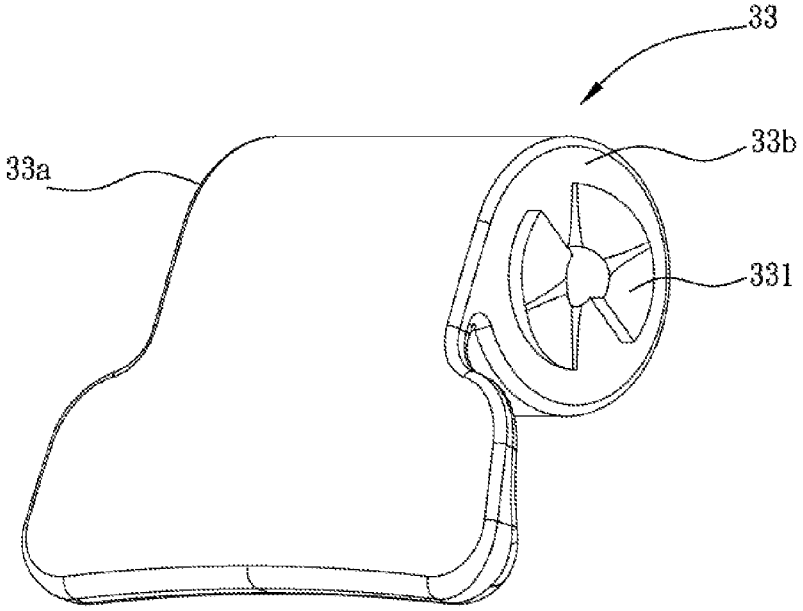

Refer to FIG. 12A and FIG. 12B, the actuating member 33 is rotated around the actuation axis X and is pivotally connected to the first driven part 34. The actuating member 33 includes two ends 33*a*, 33*b*. One end (the first end) 33*a* thereof is against the end 212*a* of the pivot part 212 of the first portion 21. The other end (the second end) 33*b* is against the first driven part 34, connected to the end 212*b* of the pivot part 212 of the first portion 21 through the first driven part 34 and further connected to the end 222*b* of the mounting part 222 of the second portion 22 through the second driven part 35. The second end 33*b* of the actuating member 33 (the end facing the first driven part 34) is disposed with a helical projection surface 331 while the first end 33*a* thereof is arranged with a fourth projection 332 that is corresponding to the first stopping part 215*a* and the second stopping part 215*b* on the end 212*a* of the pivot part 212 of the first portion 21. The fourth projection 332 is located on a rotating path of the first stopping part 215*a* and the second stopping part 215*b* on the end 212*a* of the pivot part 212. Thus the rotation angle of the actuating member 33 in relative to the first portion 21 can be limited by the first and the second stopping parts 215*a*, 215*b* due to limited movement of the fourth projection 332 of the actuating member 33 between the first stopping part 215*a* and the second stopping part 215*b* when the actuating member 33 is rotated in relative to the first portion 21.

Figure 13A:
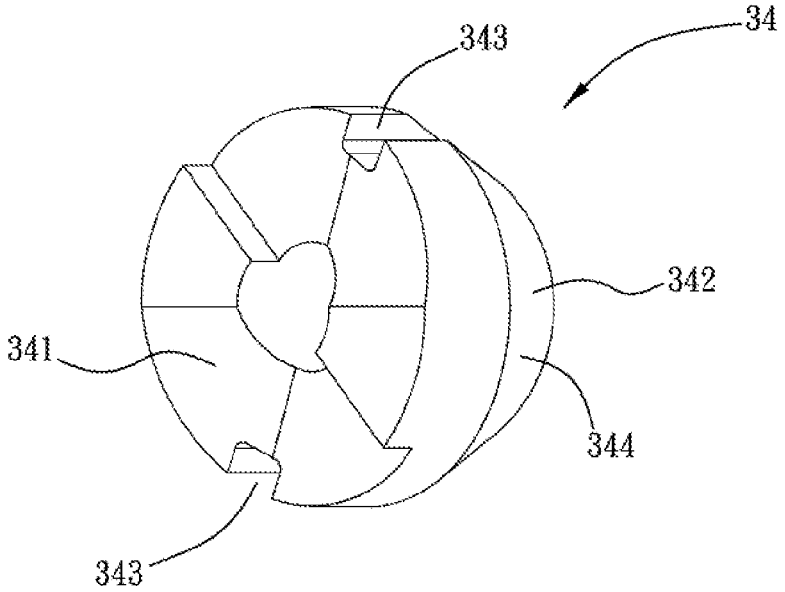
FIG. 13A and FIG. 13B are perspective views of a first driven part of an embodiment viewed from two opposite sides according to the present invention.
Figure 13B:
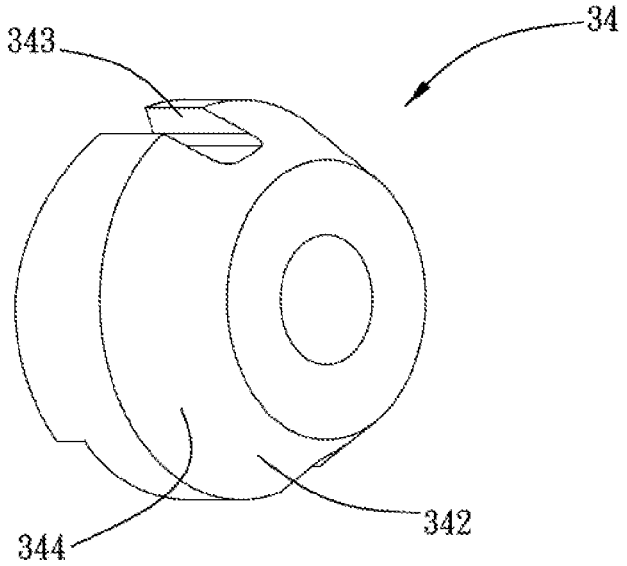

Refer to FIG. 13A and FIG. 13B, the first driven part 34 includes two opposite ends. One end of the first driven part 34 facing the helical projection surface 331 of the second end 33*b* of the actuating member 33 is arranged with a helical projection surface 341 that is symmetrical to and matched with the helical projection surface 331 of the actuating member 33. The other end of the first driven part 34 is disposed with a leaning part 342 used for leaning against one end of the second driven part 35. At least two slots 343 corresponding to and matched with the first projections 214 in the first receiving space 213 of the end 212*b* of the pivot part 212 are mounted on the first driven part 34 along the axis of the first driven part 34 (the direction of the actuation axis X) so that the first projections 214 are able to be moved along the length direction of the slots 343 (the direction of the actuation axis X). The first driven part 34 is stopped in the first receiving space 213 of the end 212*b* of the pivot part 212 and the rotation of the first driven part 34 is prevented by the first projections 214 of the first receiving space 213 received in the slots 343. Yet the first projections 214 are able to be moved in the length direction of the slots 343 (the direction of the actuation axis X).

Figure 14A:
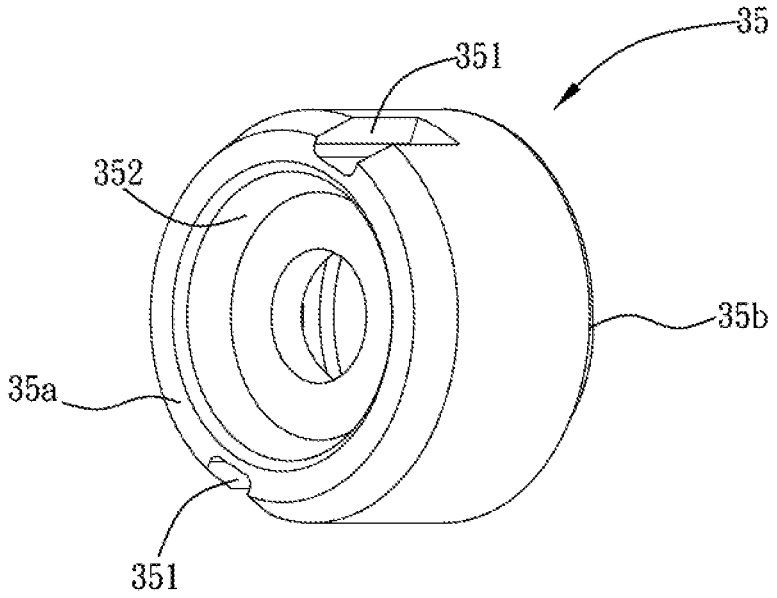
FIG. 14A and FIG. 14B are perspective views of a second driven part of an embodiment viewed from two opposite sides according to the present invention.
Figure 14B:
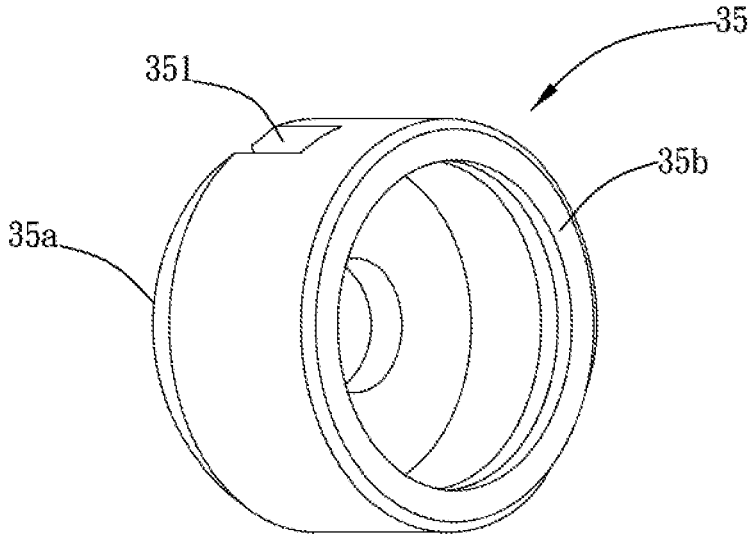

Refer to FIG. 14A and FIG. 14B, the second driven part 35 includes two ends-a first end 35*a*, 35*b* in the opposite sites. The first end 35*a* is used for leaning against the leaning part 342 of the first driven part 34 while the second end 35*b* is for leaning against the end 222*b* of the mounting part 222 of the second portion 22. At least two slots 351 corresponding to and matched with the second projections 224 in the second receiving space 223 of the end 222*b* of the mounting part 222 of the second portion 22 is mounted on the second driven part 35 along the axis of the second driven part 35 (the direction of the actuation axis X) so that the second projections 224 are able to be moved along the length direction of the slots 351 (the direction of the actuation axis X). The second driven part 35 is stopped in the second receiving space 223 of the end 222*b* of the mounting part 222 and the rotation of the second driven part 35 is prevented by the second projections 224 of the second receiving space 223 received in the slots 351. Yet the second projections 224 are able to be moved in the length direction of the slots 351 (the direction of the actuation axis X).

Moreover, the leaning part 342 of the first driven part 34 includes an inclined surface 344. The inclined surface 344 improves the stability while the first driven part 34 is in contact with the first end 35*a* of the second driven part 35. The first end 35*a* of the second driven part 35 is disposed with a slotted hole 352 tapered inward and used for receiving the leaning part 342. The first driven part 34 and the second driven part 35 are connected more closely by the leaning part 342 and the slotted hole 352 against each other.

When the actuating member 33 works, the actuating member 33 is engaged with the first driven part 34 by the helical projection surface 331 of the actuating member 33 in contact with the helical projection surface 341 of the first driven part 34 for driving the first driven part 34 along the actuation axis X and further driving the second driven part 35. Thereby the two ends 222*a*, 22*b* of the mounting part 222 of the second portion 22 in contact with the second driven part 35 become moved and apart from each other. Thereby the second portion 22 is unable to be pivotally moved in relative to the first portion 21. Thus the pivot member 20 is fastened.

In this embodiment, the actuating member 33 is pushed downward for fastening (as shown in FIG. 7A) and moved upward for being released to a loose state (as shown in FIG. 7B).

In order to keep close contact between the helical projection surface 331 of the actuating member 33 and the helical projection surface 341 of the first driven part 34, the gap between the first driven part 34 and the second driven part 35 and the gap between the second driven part 35 and the second portion 22 are filled by the connection portion 31 respectively.

The actuating member 33 with the design mentioned above can transmit larger force and the position of the second portion 22 in relative to the first portion 21 can be adjusted in a straight way during the movement of the actuating member 33.

The fastener assembly30 is moved around the actuation axis X. Thereby the force required and applied to the fastener assembly30 is reduced. Moreover, compared with the bending pivot member 20, the fastener assembly30 is only projecting from the pivot member 20 a little bit. Thus the risk of injuries is lowered.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A chair headrest comprising:

a headrest having a concave surface disposed vertically, a convex surface arranged horizontally, a front-side part, a rear-side part, and a middle part set between the front-side part and the rear-side part; wherein the front-side part and the middle part are connected to one part that is able to be moved vertically relative to the rear-side part; a damper is arranged between the middle part and the rear-side part to provide a resistance during vertical movement of the front-side part and the middle part relative to the rear-side part; a guide and stop member is disposed between the middle part and the rear-side part for guiding and stopping the vertical movement of the front-side part and the middle part relative to the rear-side part;

a pivot member including:

a first portion having one end thereof disposed with a fixing part for being fixed on a seat back and the other end thereof arranged with a pivot part; wherein the pivot part includes two separate ends with a space therebetween;

a second portion having one end thereof disposed with an assembly part for being connected to the headrest and the other end thereof arranged with a mounting part fitted to the pivot part correspondingly; wherein the mounting part includes two separate ends with a space therebetween and corresponding to the two ends of the pivot part of the first portion respectively; the mounting part and the pivot part are pivotally connected to each other so that the first portion and a second portion are able to be rotated around an actuation axis; and a fastener assembly having a connection portion arranged at the actuation axis and used for connecting the two ends of the pivot part of the first portion and the two ends of the mounting part of the second portion; and an actuator assembly used to make the two ends of the mounting part of the second portion separate from each other along the actuation axis and arranged between the two ends of the mounting part of the second portions; wherein the actuator assembly includes an actuating member, a first driven part and a second driven part that are fitted over the connection portion in turn; the actuating member is rotated around the actuation axis, connected to one of the two ends of the pivot part of the first portion through the first driven part and further connected to one of the two ends of the mounting part of the second portion through the second driven part.

2. The device as claimed in claim 1, wherein an interface is set between the actuating member, the first driven part and the second driven part of the actuator assembly so that a frictional force is applied to the two ends of the mounting part of the second portion by the actuating member, the first driven part and the second driven part.

3. The device as claimed in claim 1, wherein the first driven part has at least two slots; one of the two ends of the pivot part of the first portion that is connected to the first driven part includes a first receiving space; at least two first projections with an interval therebetween are disposed on an inner surface of the first receiving space; the at least two first projections engaging with the at least two slots on the first driven part along an axis of the first driven part.

4. The device as claimed in claim 3, wherein the second driven part has at least two slots; one of the two ends of the mounting part of the second portion that is connected to the second driven part includes a second receiving space; at least two second projections with an interval therebetween are disposed on an inner surface of the second receiving space; the at least two second projections engaging with the at least two slots on the second driven part along an axis of the first driven part.

5. The device as claimed in claim 4, wherein a first stopping part and a second stopping part with a space therebetween are disposed on one of the two ends of the pivot part of the first portion; the second portion is disposed with a third projection corresponding to the space between the first stopping part and the second stopping part on the end of the pivot part; the third projection pivots on a rotating path formed by the space between the first stopping part and the second stopping part on one of the two ends of the pivot part.

6. The device as claimed in claim 5, wherein the actuating member includes two opposite ends; one of the two ends is against one of the two ends of the pivot part of the first portion while the other end of the actuating member includes two flat surfaces and a first helical projection surface that is obliquely connected with and disposed between the two flat surfaces.

7. The device as claimed in claim 6, wherein a first stopping part and a second stopping part with a space therebetween are disposed on one of the two ends of the pivot part of the first portion; one of the two ends of the actuating member is arranged with a fourth projection that is corresponding to the space between the first stopping part and the second stopping part on one of the two ends of the pivot part of the first portion; the fourth projection pivots on a rotating path formed by the space between the first stopping part and the second stopping part on one of the two ends of the pivot part.

8. The device as claimed in claim 6, wherein the first driven part includes two opposite ends; one of the two ends of the first driven part is disposed with a second helical projection surface that is symmetrical to and matched with the first helical projection surface of the actuating member; the other end of the first driven part is arranged with a conical part used for contacting with one end of the second driven part.

9. The device as claimed in claim 8, wherein the second driven part includes two ends; one of the two ends is for leaning against the conical part of the first driven part while the other end is for leaning against one of the two ends of the mounting part of the second portion.

10. The device as claimed in claim 9, wherein the first driven part is tapered from the end disposed with the helical projection surface to the end arranged with the conical part while one end of the second driven part is mounted with a slotted hole tapered inward for receiving the conical part.

11. The device as claimed in claim 1, wherein the connection portion includes a first connection element and a second connection element; one end of the first connection element is passed through the two ends of the pivot part of the first portion and the two ends of the mounting part of the second portion for connecting the first portion to the second portion; the second connection element is threaded and connected to the end of the first connection element.

12. The device as claimed in claim 1, wherein the front-side part is disposed with at least two locking parts with an interval therebetween and the middle part is arranged with at least two locked parts corresponding to the locking parts of the front-side part; the front-side part and the middle part are connected to one part by fastening the locking parts of the front-side part and the locked part middle part with each other.

13. The device as claimed in claim 12, wherein the locking part of the front-side part includes a through hole and an edge of the through hole is set with at least one slot.

14. The device as claimed in claim 13, wherein the locked part of the middle part includes a projecting block and the projecting block is disposed with a projection that is fastened with the slot correspondingly.

15. The device as claimed in claim 1, wherein the damper includes at least two damping wheels and at least two toothed racks that correspondingly engage with each other; the damping wheels are disposed with a space therebetween on one surface of the middle part facing the rear-side part respectively while the two toothed racks corresponding to the damping wheels are disposed in parallel and arranged vertically at one surface of the rear-side part facing the middle part.

16. The device as claimed in claim 1, wherein the guide and stop member includes at least two positioning blocks and at least two grooves; each of the positioning blocks is able to be passed through a corresponding one of the grooves and moved in a length direction of the groove; wherein the two positioning blocks are set on the left side and the right side respectively of one surface of the rear-side part facing the middle part while the two grooves corresponding to the positioning blocks are arranged vertically and in parallel at the middle part.

17. The device as claimed in claim 16, wherein the guide and stop member further includes at least one positioning part; the positioning part is arranged at one side of the groove opposite to the side with the positioning block; the positioning part is further connected to the positioning block by a connection part.

* * * * *